US006530648B2

(12) United States Patent
Leu et al.

(10) Patent No.: US 6,530,648 B2
(45) Date of Patent: Mar. 11, 2003

(54) APPARATUS FOR USING BUBBLE AS VIRTUAL VALVE TO EJECT INK AND FABRICATING METHOD THEREOF

(75) Inventors: Yi-Jing Leu, Hsinchu (TW); Hung-Sheng Hu, Kaohsiung (TW); Tsung-Ping Hsu, Jungli (TW); Wei-Lin Chen, Taipei (TW); In-Yao Lee, Shijr (TW); Chung-Cheng Chou, Taipei (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/138,291

(22) Filed: May 6, 2002

(65) Prior Publication Data

US 2002/0163564 A1 Nov. 7, 2002

(30) Foreign Application Priority Data

May 7, 2001 (TW) ..... 90110879 A

(51) Int. Cl.[7] ..... B41J 2/14; B41J 2/16; B41J 2/05; B41J 2/17

(52) U.S. Cl. ..... 347/48; 347/65; 347/94

(58) Field of Search ..... 347/48, 56, 61, 347/63, 65, 67, 94, 15, 44

(56) References Cited

U.S. PATENT DOCUMENTS 4,494,128 A * 1/1985 Vaught ..... 347/67
6,102,530 A * 8/2000 Kim et al. ..... 347/65

* cited by examiner

*Primary Examiner*—John Barlow
*Assistant Examiner*—Juanita Stephens
(74) *Attorney, Agent, or Firm*—Rabin & Berdo, PC

(57) ABSTRACT

An apparatus for using the bubble as a virtual valve to eject ink comprises a chamber, orifice, and heaters. The chamber, having a top surface and a bottom surface, is connected to the ink reservoir by a manifold. Two heaters, connected in series to a common electrode, are located on the bottom surface of the chamber. One heater having higher resistance is positioned adjacent to the manifold, and the other heater having lower resistance is positioned away from the manifold. When an electrical pulse is applied to activate the heaters, the heater close to the manifold heats up first, and generates a first bubble to isolate the ink flow between the chamber and manifold, thereby reducing the effects of cross talk. Subsequently, the heater away from the manifold generates the second bubble to pressurize the ink in the chamber with the first bubble, and the ink is ejected through the orifice. Then, the first bubble collapses, and breaks the isolation between the manifold and the chamber. The ink in the manifold immediately refills to the chamber.

11 Claims, 6 Drawing Sheets

(PRIOR
ART)

APPARATUS FOR USING BUBBLE AS VIRTUAL VALVE TO EJECT INK AND FABRICATING METHOD THEREOF

This application incorporates by reference of Taiwan application Serial No. 90110879, filed on May 7, 2001.

BACKGROUND OF THE INVENTION

1. Field of the Invention

The invention relates in general to an ink injector, and more particularly to an apparatus for using bubble as a virtual valve to eject ink and a fabricating method thereof.

2. Description of the Related Art

Over the years, electronic related industries have progressed as the technology advances. For various electronic products, such as computer systems, computer peripherals, appliances and office machines, their functions and appearances have improved greatly as well. For example, in the 1980s, impact-type dot matrix printers and monochrome laser printers were pre-dominant. Later in the 1990s, monochrome inkjet printers and color inkjet printers became popular for general-purpose use while color laser printers were available for professional use. For general use, users would probably choose color inkjet printers after considering the printing quality and price. Users with sufficient budgets would probably purchase a monochrome laser printer. Since the price and quality are critical to the users' decisions, printer manufacturers aggressively develop their products so that the products have lower cost and better quality, in order to increase the popularity and profit of their products. Therefore, developers are focusing on how to improve the performance of products under limited cost.

Most inkjet printers now use either a bubble inkjet printhead or a piezo-electrical inkjet printhead to eject ink droplets onto a recording medium, such as paper, for printing. The bubble inkjet printhead comprises a plurality of chambers adjacent one another. Each chamber comprises at least a heater, ink, and an orifice. Also, a manifold is adjacent to and in flow communication with the chamber. Ink from a reservoir is supplied to each chamber by passing through the associated manifold. The heater heats the ink of the chamber to create bubbles until the bubbles expand enough to expel the ink droplets through the orifice and onto the recording medium, such as a sheet of paper. When the activation of the heater is terminated, the bubbles collapse so that the ink in the reservoir refills into the chamber through the manifold. Adjusting the concentrations and locations of the droplets on the paper can form a variety of texts and graphics. The quality of the printing result is related to the resolution provided by the printer. Currently, entry-level color printers provide a good resolution of 720×720 dpi (dots per inch) or 1440×720 dpi. The finer size the droplet is, the higher resolution the printer has.

However, those bubble inkjet systems (also known as thermally driven bubble system) suffer from cross talk and satellite droplets. When the bubbles expand, the ink is pushed from all sides, so the ink in the chamber is not only ejected through the orifice, but is also pushed towards the manifold. Such effect will deteriorate the ink stability of the adjacent chambers. If the adjacent chamber with unstable ink performed ink ejection, some problems may arise. For example, the size of droplets may vary, or the droplets may hit the paper surface at slightly different locations. After the bubbles collapse, the refilling of the ink into the chamber may also interfere with the ink in the adjacent chambers. The phenomena described above are known as cross talk. Cross talk frequently occurs when the chambers are placed in arrays with close pitch, and the droplets eject from the adjacent orifices. Moreover, the unstable ink condition may affect the ink ejected through the orifice, causing satellite droplets. For example, the ink close to orifice could overflow, or the tail of ink droplet would not be cut off abruptly. The tiny ink droplets that trail the main droplets, known as satellite droplets, may hit the paper at locations slightly different than the main droplets and blur the printed image. The problems of cross talk and satellite droplets degrade the sharpness of printed image. Various technologies have been provided to solve these problems.

Generally, to increase the resolution of the print image, the orifices of the inkjet printhead for ejecting ink from the chamber are arranged in the form of arrays. In practical application, all ink chambers have identical, or very similar, structure; hence, only one ink chamber is illustrated in the following description and related drawings.

FIG. 1 is a cross-sectional view of a known ink chamber on the printhead (disclosed in U.S. Pat. No. 4,494,128), wherein the printhead is particularly applied in a gray scale inkjet printer. An ink reservoir and a vehicle reservoir (not shown in FIG. 1) are used for storing undiluted ink 10 and appropriate diluting vehicle 12, respectively. Also, the ink reservoir and the vehicle reservoir are connected to a chamber 18 by ink capillary 14 and vehicle capillary 16, respectively. The vehicle 12 can be a solvent employed to dissolve the dye in the undiluted ink 10. Varying the ratio of the ink 10 and vehicle 12 produces a wide range of ink concentrations. A discharge orifice 22 is formed on the top surface 19 of the chamber 18. Within the chamber 18 is a means of discharging the ink, such as a heater 20, which heats the ink to create the bubble for expelling a droplet 23 through the discharge orifice 22. The ink valve 24 and vehicle valve 26 are resistors set in the ink capillary 14 and vehicle capillary 16 for controlling the volume of ink 10 and vehicle 12 entering into the chamber 18. When an electrical current is applied to the resistors, the valve bubble is generated in the ink capillary 14 and/or in the vehicle capillary 16 to stop the flow of ink 10 and/or vehicle 12 to enter the chamber 18. The ink valve 24 and vehicle valve 26 can be turned on or off independently for any desired length of time. By appropriately determining the ratios of on/off times of the ink valve 24 and the vehicle valve 26, a full gray scale range of printing is produced. This conventional method creates a narrow region in which a heater is placed. The bubble generated from the heater is able to block the flow of ink 10 or vehicle 12, in order to reduce the effects of cross talk. However, after the droplet 23 has been ejected, the narrow region makes it difficult to refill the chamber 18 with the ink 10 and/or vehicle 12 quickly.

FIG. 2 is an enlarged view of another known ink chamber on the printhead (disclosed in U.S. Pat. No. 5,278,584). There is a discharge means such as the heater 32 on the substrate 29 of the chamber 30. By applying the electrical current to turn on the heater 32, the bubble is generated to expel the ink out of the orifice 34. Subsequently, the chamber 30 is refilled by capillary action. The ink stored in the reservoir flows through the manifold, the channel 36, and the chamber 30, as shown by the arrow A.

According to this conventional method, the channel 36 between the manifold and the chamber 30 has a buffering effect on the ink in the chamber 30. For example, the variation in ink pressure, due to ink ejection or bubble formation, can be blocked by the channel 36. Therefore, the interfering effects of cross talk on the adjacent chambers, caused by the ejection of ink, can be reduced. However, the rate of refilling ink to the chamber 30 is subject to the cross-sectional area of channel 36, and the ink jet frequency of the printer is decreased.

In other words, in FIG. 2 when the bubble is generated and collapsed, the cross talk effects caused by the disturbed flow of ink can be reduced by building a channel between the manifold and the chamber. However, the existence of the channel also prolongs the time for refilling the chamber with ink.

Accordingly, the main goals for researchers and manufacturers are to prevent the cross talk phenomena, increase the flow rate of ink to refill the chamber, and enhance the resolution of inkjet printing. In reference to U.S. Pat. No. 6,102,530 (which is also assigned to the same assignee as the present application), it is described that setting two heaters on two sides of an orifice not only functions as virtual valve but also increases the refill rate of ink.

FIG. 3 is a cross-sectional view of another known ink chamber on the printhead. The manifold 42 is adjacent to and in flow communication with the chamber 40. Ink from the reservoir (not shown) is supplied to the chamber 40 by passing through the manifold 42. Also, the ink is ejected through the orifice 46 that is formed on the top surface 45 of the chamber 40. The discharge resistors, such as the first heater 48 and second heater 50, placed on the opposite sides of the orifice 46 possess different resistances and are electrically connected to a common electrode (not shown) for activating the ink in the associated chamber 40.

After a common electrical pulse is applied, the first heater 48 and second heater 50 are activated simultaneously. Due to the resistance difference, the first heater 48, having a narrower cross-section, is activated more quickly and generates a first bubble 52. The expanding first bubble 52 begins to restrict the ink flow to the manifold 42, and finally functions as a virtual valve to isolate the chamber 40 and to prevent the adjacent chambers from cross talk. Then, a second bubble 54 is formed by the second heater 50. As the second bubble 54 expands and approaches the first bubble 52, the ink 44 is pressurized by the first bubble 52 and second bubble 54 and is ejected through the orifice 46 in the direction F, thereby forming a droplet 56. Following the ink ejection, the first bubble 52 and second bubble 54 begin to collapse in the direction P, thereby allowing ink 44 to refill the chamber 40 through the manifold 42 in the direction shown by the arrow R. Accordingly, the first bubble 52 functions as a virtual valve and prevents the cross talk problem. The refill rate of ink is increased by designing a chamber 40 without a narrow channel. However, there is still a drawback in the manufacture of this printhead. During the manufacturing process, the silicon substrate is anisotropically etched to form the manifold 42 and chamber 40. Therefore, the etching process has to be carefully controlled. In addition, a support layer 58 has to be constructed on the top of the chamber 40 for placing the heaters. It is critical to control the construction of the support layer 58, in order to meet the high requirements of production yield and durability.

Accordingly, to increase production yield and enhance market competition, there is a need for researchers to minimize cross talk and its related effects, and to increase the ink-refill rate without further complicating the manufacturing process.

SUMMARY OF THE INVENTION

It is therefore an object of the invention to provide an apparatus and method for using the bubble as a virtual valve to eject ink, in order to reduce the cross talk effects, increase ink-refill rate, and also fabricate the inkjet cartridge with high production yield and durability by a simpler manufacturing method.

According to the objective of the invention, an apparatus for using the bubble as a virtual valve to eject ink is provided. The said apparatus comprises a chamber, orifice, and heater. The chamber is connected to the ink reservoir by a manifold, so that the ink can flow into the chamber through the manifold. An orifice for ejecting ink is located on the top surface in ink communication with the chamber. The chamber has a top surface and a bottom surface. Two heaters are located on the bottom surface of the chamber, wherein one heater is located near the manifold and the other is located away from the manifold. These two heaters are connected in series to a common electrode. In addition, the heater closer to the manifold has a smaller cross-section and consequently has a higher resistance. When an electrical pulse is applied to activate the heaters, the heater closer to the manifold heats up first, and generates a first bubble to isolate the ink flow between the chamber and the manifold. Subsequently, the other heater, which is located away from the manifold, generates a second bubble to pressurize the ink in the chamber with the first bubble, thereby the ink is ejected through the orifice and forms an ink droplet. Then, the first and second bubbles collapse, and remove the isolation between the manifold and the chamber. The ink in the manifold immediately refills the chamber.

In the invention, the first bubble generated by the heater closer to the manifold functions as a virtual valve to isolate the manifold and chamber, so that the cross talk effects on the adjacent chambers can be reduced. Also, the channel between the manifold and the chamber is wide enough so the ink can refill the chamber very quickly. Thus, cross talk is decreased and the printing speed can be increased. Moreover, according to the fabricating method of the invention, the heaters are formed in the bottom surface of the chamber by deposition, so that the components in the chamber are easily constructed and the thin plate, having the orifice, spans the chamber without any burden. Therefore, the production yield and durability are greatly increased.

Other objects, features, and advantages of the invention will become apparent from the following detailed description of the preferred but non-limiting embodiments. The following description is made with reference to the accompanying drawings.

DETAILED DESCRIPTION OF THE INVENTION

The details of the invention are described below. It will be appreciated that applications of the invention may vary from the preferred embodiments without departing from the main concepts disclosed herein. Also, to avoid obscuring the invention, well-known elements not directly relevant to the invention are neither shown nor described. Accordingly, the specifications and the drawings are to be regard in an illustrative sense rather than a restrictive sense.

Figure 4:
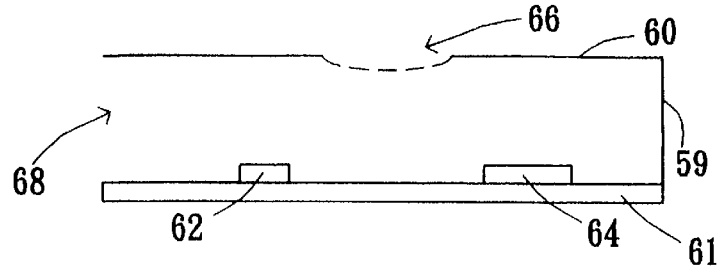
FIGS. 4*a*~4*e* show simple drawings of an inkjet chamber according to one embodiment of the invention.
Figure 4:
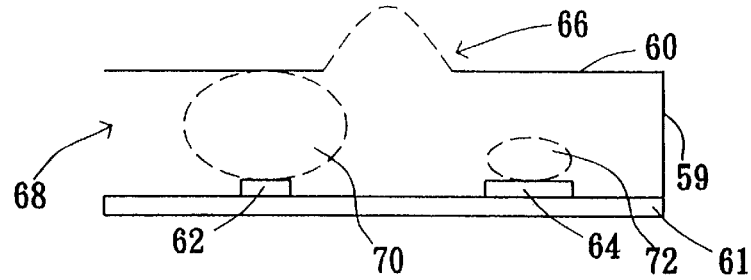
Figure 4:
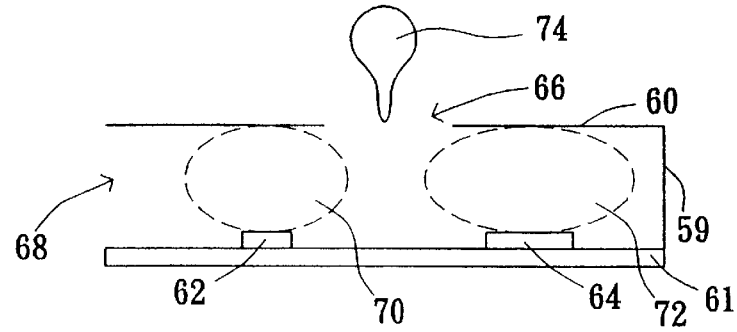
Figure 4:
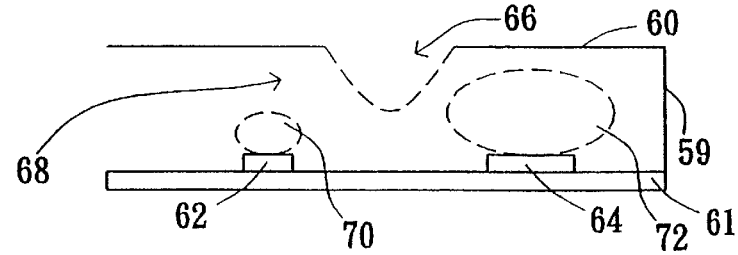
Figure 4:
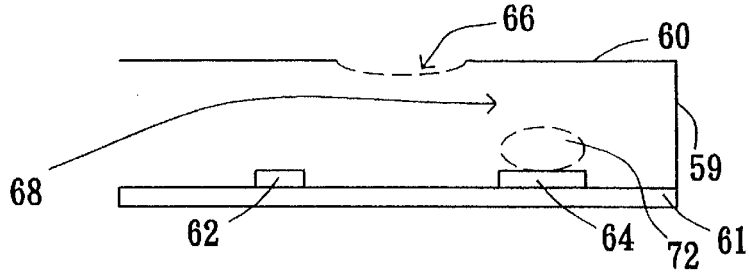

Referring to FIG. 4(*a*)~FIG. 4(*e*), they show simple drawings of an inkjet chamber according to one embodiment of the invention. The chamber 59 has a top surface 60 and a bottom surface 61, as shown in FIG. 4(*a*). An orifice 66 is formed in the top surface 60, while a first heater 62 and a second heater 64 are placed on the bottom surface 61. Ink 68 from the ink reservoir (not shown) is supplied to the chamber 59 through the manifold. Generally, ink at the orifice 66 steadily maintains as the meniscus level due to its own cohesion. The first heater 62 and the second heater 64 are connected in series to a common electrode. Also, the first heater 62 has a narrower cross-section and is closer to the manifold than the second heat 64 is to the manifold. Because the resistance is inversely proportional to the cross-sectional area, the first heater 62 has a higher resistance than the second heat 64.

Referring to FIG. 4(*b*), when an electrical pulse is applied to activate the first heater 62 and the second heater 64, the first heater 62 heats up more quickly than the second heater 64 because of its higher resistance. In other words, the first heater 62 can accumulate higher heat energy, so as to vaporize the ink 68 and generate a first bubble 70. As the first bubble 70 expands, it begins to restrict and finally isolates the ink flow between the manifold and the chamber 59. Thus, the expansion of the first bubble 70, functioning as a virtual valve, can effectively control the ink flow in the chamber 59, and prevent the adjacent chambers from cross talk effects. Meanwhile, the ink 68 at the orifice 66 is pressurized by the expanding first bubble 70. The ink level becomes convex, as shown in FIG. 4*b*.

Referring to FIG. 4(*c*), a second bubble 72 is generated above the second heater 64 in the chamber 59 following the formation of the first bubble 70. When the expanding second bubble 72 approaches the expanding first bubble 70, the pressurized ink 68 in the chamber 59 is ejected through the orifice 66 and forms a droplet 74. When the first bubble 70 and second bubble 72 coalesce, the tail of the ink is abruptly cut off, thereby preventing the formation of a satellite droplet.

Referring to FIG. 4(*d*), the liquid level of the ink 68 at the orifice 66 represents a concave shape after the ejection of droplet 74. The first heater 62 and the second heater 64 stops heating, and the first bubble 70 and the second bubble 72 collapse. When the first bubble 70 collapses, the chamber 59 is no longer isolated, so the ink 68 rapidly flows into the chamber 59, as shown by the arrow. Next, the second bubble 72 collapses, the ink 68 fully refills the chamber 59, as shown in FIG. 4(*e*). There is no restricted flow of ink between the chamber 59 and the manifold. The ink at the orifice 66 steadily maintains as the meniscus level again.

Figure 1:
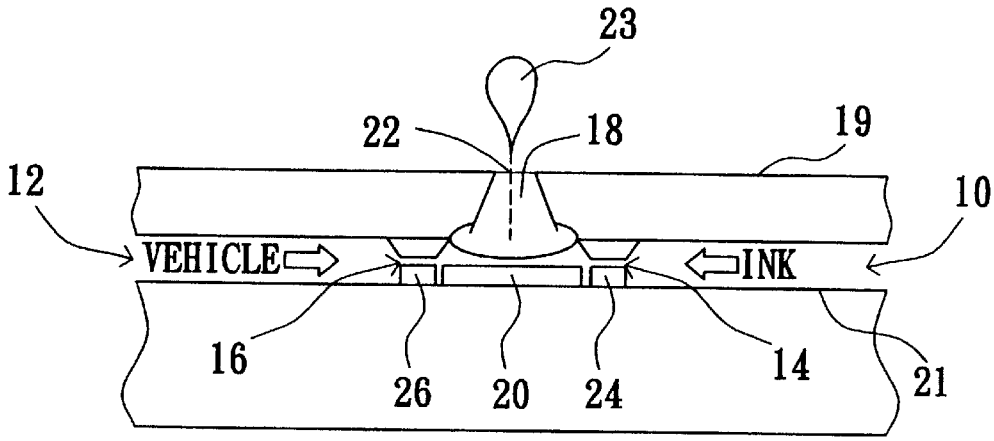
FIG. 1 (PRIOR ART)
FIG. 1 (prior art) is a cross-sectional view of a known ink chamber on the printhead.
Figure 2:
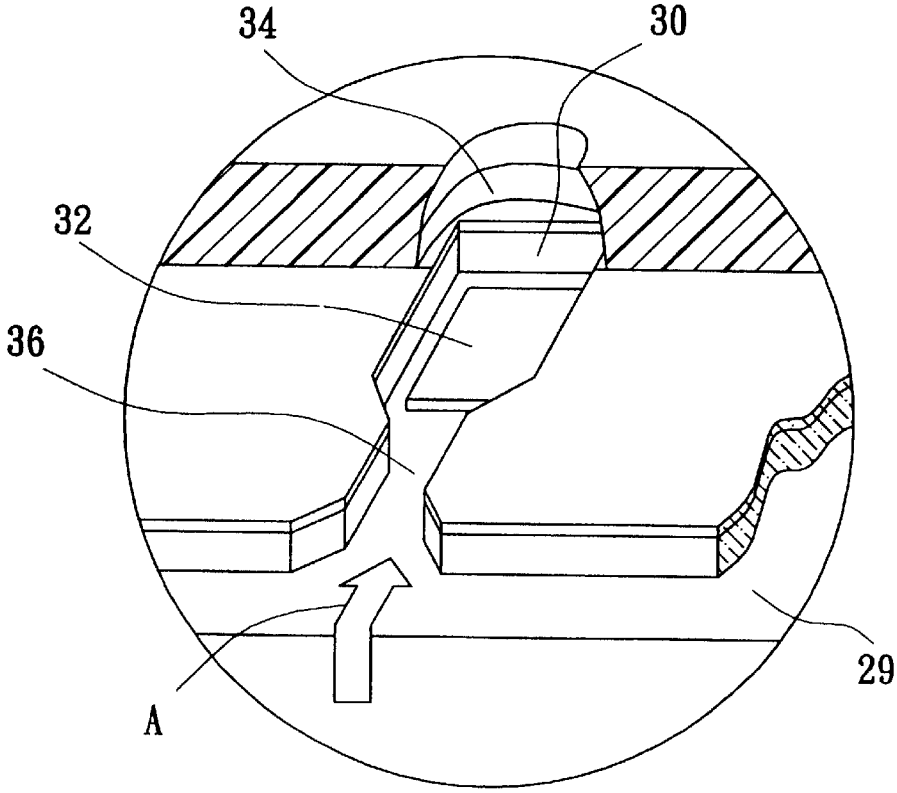
FIG. 2 (PRIOR ART)
FIG. 2 (prior art) is an enlarged view of another known ink chamber on the printhead.

Usually, the flow rate of ink, for refilling the chamber through the manifold, depends on the pressurized loading of the ink applied by the ink cartridge, and the flow resistance that the ink encounters through the manifold. Several factors affect the flow resistance, such as the cross-sectional area, shape, and roughness of the channel, and the viscosity and surface tension of the ink. High flow resistance increases the ink-refill time, and consequently decreases the operation frequency of inkjet printing. In the present invention, the generation of the first bubble 70 can isolate the manifold and the chamber to restrict the ink flow, without using a conventional buffering structure such as the narrow channel (as shown in FIG. 1 and FIG. 2). Therefore, in the disclosed apparatus for using the bubble as a virtual valve, the flow resistance of ink is decreased and as a result, the refill rate is increased; accordingly, the printing rate and resolution of the inkjet printer are increased.

Figure 5:
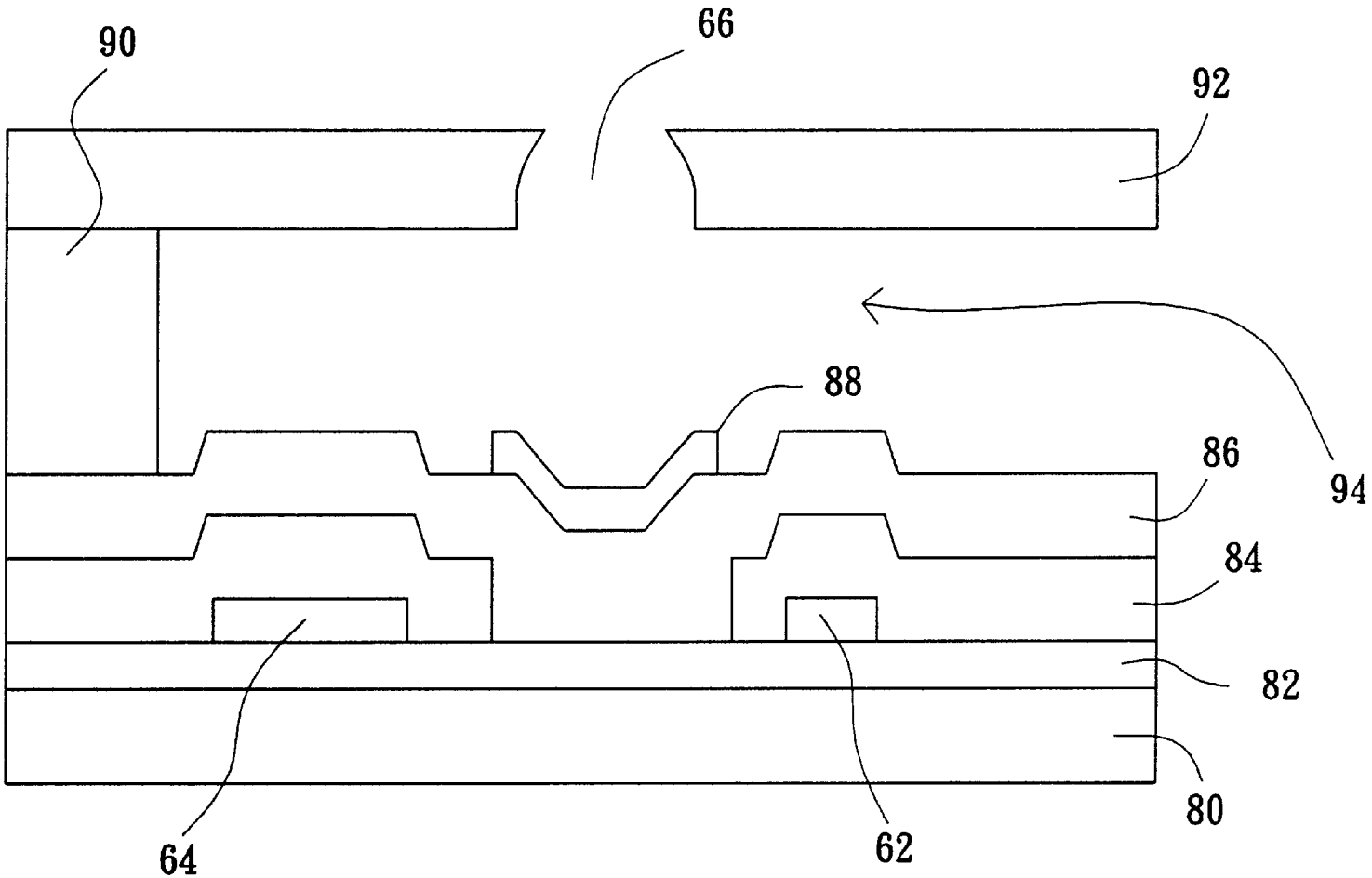
FIG. 5 is a cross-sectional view of an ink chamber according to one embodiment of the invention.

FIG. 5 is a cross-sectional view of an ink chamber according to one embodiment of the invention. First, a substrate 80 is provided, and single-crystalline silicon is adopted in the process. A dielectric layer 82, composed of silicon oxide ($SiO_2$) for example, is deposited over the substrate 80. A resistance layer (not shown in FIG. 5) can be further formed on the dielectric layer 82. The resistance layer could be TaAl, $HfB_2$, or other alloys combining transition elements. Next, an Al layer is deposited on the resistance layer in order to form a conductive layer 84. A first heater 62 and a second heater 64 are formed by etching the conductive layer 84 and the resistance layer. Then, for isolating the heaters from the ink, a SiNx or SiNx-SiC complex is further deposited by PECVD (Plasma-Enhanced Chemical Vapor Deposition) method to form a protective layer 86. A metal layer 88 (such as Ta) is deposited on the top of the protective layer 86. The metal layer 88 is to prevent possible damage due to the striking of the collapsing bubble against the protective layer 86. A thick polymer film 90 is further deposited over the protective layer 86 and the metal layer 88. Then, patterning the polymer film 90 to form the flow channel by photolithography. Finally, a thin plate 92 containing an extremely small hole is attached over the polymer film 90, in order to form the orifice 66. The orifice 66 could be formed by Laser Ablation or Electroforming.

Figure 3:
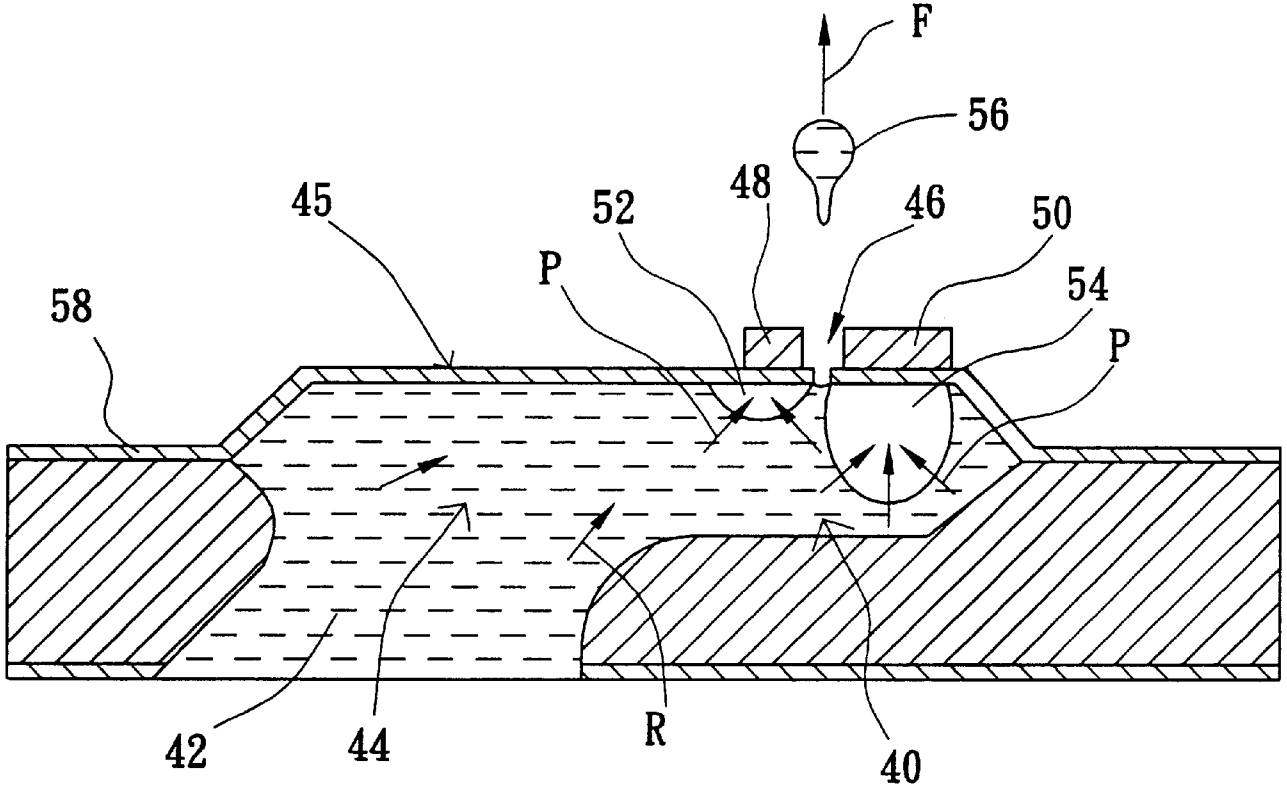
FIG. 3 (PRIOR ART)
FIG. 3 (prior art) is a cross-sectional view of another known ink chamber on the printhead.

Compared to the conventional process, in which the chamber of FIG. 3 is formed by etching, it is much easier to form each component of the ink chamber by using the process of the present invention. Also, the heaters of the invention are set on the bottom of the chamber, so that the thin plate 92 can span the chamber without carrying any weight. Moreover, the thick polymer film 90 provides extra support for the chamber, and thus, the production yield and durability of inkjet cartridge are greatly increased.

Additionally, to increase the resolution of the print image, it is the trend of commercial ink cartridge to reduce the size of chambers and orifices, so as to arrange more chambers and orifices on the inkjet cartridge. If there is a narrow channel (as adopted in the conventional design shown in FIG. 2) between the chamber and the manifold, then reducing the size of the chamber also makes the neck of the associated channel even narrower. Consequently, refilling the chamber with ink becomes more difficult and time-consuming. In addition, the existence of a narrow channel also restricts the number of chambers arranged on the inkjet cartridge. The following description illustrates the effect on the number of chambers in a constant length of L, with and without narrow channel.

Figure 6A:
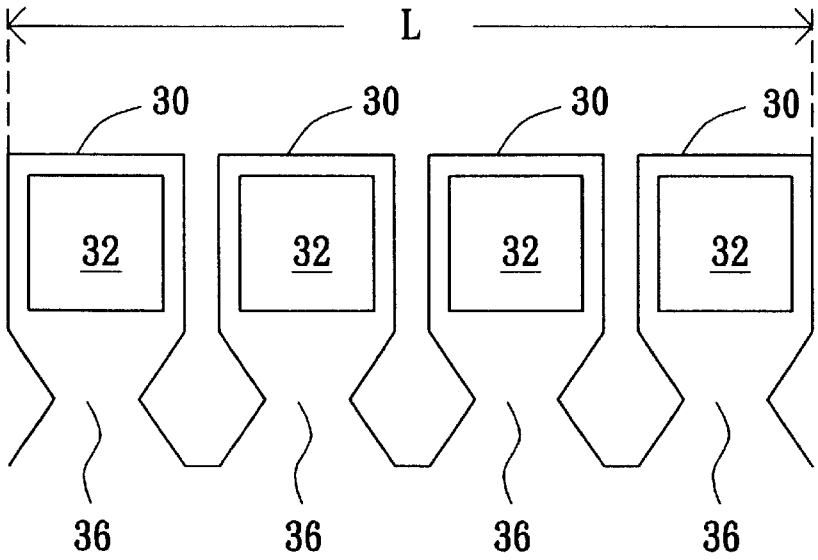
FIG. 6A (prior art) is a top view of the known ink chamber shown in FIG. 2.
Figure 6B:
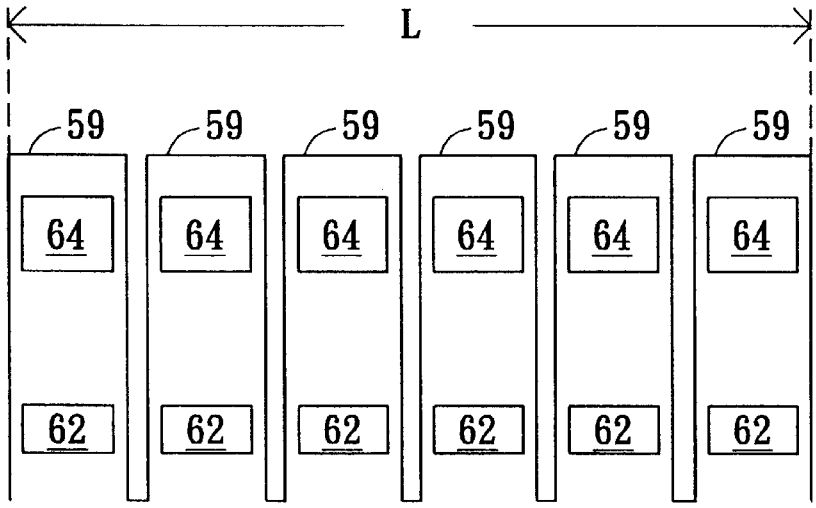
FIG. 6B is a top view of the inkjet chamber of FIG. 4(*a*), according to an embodiment of the invention.

Referring to FIG. 6A, it is a top view of the known ink chamber shown in FIG. 2 (prior art). It clearly shows that each chamber 30 contains a heater 32, and a channel 36 is the bridge of the chamber 30 and manifold. Also referring to FIG. 6B, it is a top view of the inkjet chamber of FIG. 4(*a*), according to an embodiment of the invention. Each chamber 59 contains a first heater 62 and a second heater 64. There is no narrow channel in the connection of chamber 59 and the manifold, so that the ink-refill rate of chamber 59 is much higher than that of the chamber 30 of FIG. 6A. It is noted that in FIG. 6A the neck of the narrow channel cannot be reduced too much, in consideration of ink-refill rate, therefore the size of the chamber is consequently restricted. In one embodiment of the present invention, six of the chambers 59 can be arranged in a length of L (FIG. 6B), while in the conventional apparatus, only four of the chambers 30 can be arranged in the same length of L (FIG. 6A). According to the illustration, the design of the narrow channel restricts the number of chambers that can be arranged on the ink cartridge, although it could reduce cross talk. On the contrary, the objective of high-speed printing and high resolution can be achieved by adopting the chamber of the invention (without the existence of a narrow channel) in the ink cartridge.

According to the aforementioned description, ink ejected through the orifice is expelled by two bubbles, wherein the bubbles are generated from the heaters situated on the bottom of the chamber. The bubble generated from the heater located closer to the manifold functions as a virtual valve by isolating the ink flow between the chamber and the manifold, so cross talk can be effectively prevented. The position of the first heater 62 is not strictly limited to a certain location. It will suffice to accomplish the invention as long as the first heater 62 (as shown in FIG. 5) is placed in a position closer to the manifold and the bubble generated can successfully block the chamber from the manifold. Regarding the second heater 64, its position depends on the size of the droplet. If the desired size of the droplet is small, the volume of ink ejected through the orifice needs to be small. Consequently, the pitch between the first heater 62 and second heater 64 has to be small. In other words, the closer the heaters are, the less the ink is ejected.

Additionally, without changing the spirit of the invention, the second heater can be replaced by a plurality of heaters. The plurality of heaters may be located on the substrate 80 and be located on a side being away from the manifold, with equal or non-equal distance from each other.

Figure 7:
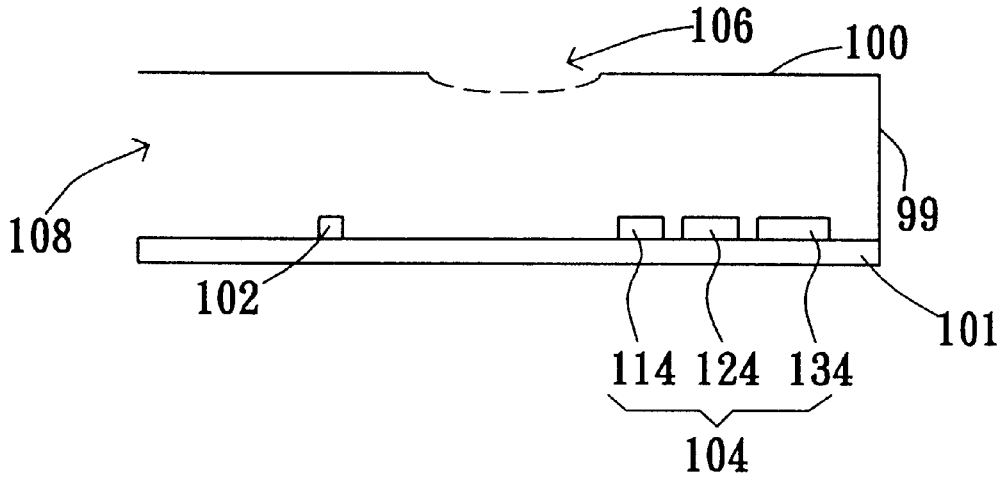
FIG. 7 shows a simple drawing of another inkjet chamber of the invention.

Referring to FIG. 7, it shows a simple drawing of another inkjet chamber of the invention. The chamber 99 has a top surface 100 and a bottom surface 101. An orifice 106 is formed in the top surface 100, while a first bubble-generating apparatus 102 and a second bubble-generating apparatus 104 are placed on the bottom surface 101. The first bubble-generating apparatus 102 is a heater and is located closer to the manifold than the second bubble-generating apparatus 104 is to the manifold. The second bubble-generating apparatus 104 comprises a plurality of heaters, and is located away from the manifold. All of the heaters of the first or second bubble-generating apparatus are connected in series to a common electrode. When an electrical pulse is applied to activate the heaters, the first bubble-generating apparatus 102 heats up more quickly and generates the first bubble in order to isolate the flow of ink between the chamber and the manifold. The heaters of the second bubble-generating apparatus 104 have different resistances, so that the second bubble can be optionally generated by one of the heaters, depending on the required volume of ink ejected through the orifice 106. Simply, if the second bubble is generated by a heater farther away from the first bubble-generating apparatus 102, a bigger size of ink droplet is formed.

Although only three heaters 114, 124, and 134 are illustrated in FIG. 7 for representing the second bubble-generating apparatus 104, the number of heaters in the second bubble-generating apparatus 104 is not limited thereto in practical applications.

Additionally, the apparatus for using the bubble as a virtual valve to eject ink and the fabricating method thereof according to the invention can be applied in any kind of fluid ejecting apparatus. In the present invention, the fluid in the ejecting apparatus is not only quickly expelled, but also rapidly refills the chamber. Also, cross talk between adjacent chambers and its effects can be reduced, and the durability of the fluid ejecting apparatus is enhanced.

In the preferred embodiments described herein, the advantages of the apparatus for using the bubble as a virtual valve to eject ink and the fabricating method thereof according to the invention are summarized as follow:

1. By generating the first bubble close to the manifold to isolate the chamber and the manifold, cross talk occurring in the adjacent chambers can be reduced.

2. There is no narrow channel between the chamber and the manifold. The flow resistance of the ink can be greatly decreased, so that the ink-refill rate is increased. Consequently, the printing speed can be raised, and the applied inkjet printer may have higher resolution.

3. In the invention, the ink in the chamber is ejected through the orifice by the expansion of two bubbles and forms the droplet, wherein the bubbles are generated by two bubble-generating apparatus, such as two heaters, on the bottom of the chamber. When the two expanding bubbles finally coalesce, the tail of the ink droplet is abruptly cut off, thereby preventing the formation of a satellite droplet.

4. It is much easier to form the components of the ink chamber by using the fabricating process of the invention. Also, the heater, conventionally placed on the top of the chamber, is placed at the bottom of the chamber so that the thin plate having the orifice carries no weight and can easily span the chamber. Furthermore, the chamber is supported by a thick polymer film; thus, the production yield and durability of the inkjet cartridge are greatly increased.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An fluid ejecting apparatus, wherein the apparatus is connected to a fluid reservoir having the fluid, the apparatus comprising:

a chamber for containing the fluid, having a top surface and a bottom surface, the chamber is connected to the fluid reservoir by a manifold;

an orifice for ejecting the fluid, located on the top surface in fluid communication with the chamber;

a first bubble generator for generating a first bubble, the first bubble functioning as a virtual valve to isolate the chamber from the manifold, the first bubble generator positioned at the bottom surface and located near the manifold, and;

a second bubble generator for generating a second bubble, the second bubble subsequent to formation of the first bubble expelling the fluid out of the orifice, the second bubble generator positioned at the bottom surface and located away from the manifold.

2. The apparatus according to claim 1, wherein the first bubble generator is a first heater and the second bubble generator is a second heater, and the first heater and the second heater are connected in series to a common electrode.

3. The apparatus according to claim 2, wherein the cross-sectional area of the second heater is larger than that of the first heater.

4. The apparatus according to claim 3, wherein the first heater has a higher resistance than the second heater.

5. The apparatus according to claim 4, wherein the first heater heats up more quickly than the second heater.

6. The apparatus according to claim 1, wherein the orifice is formed by Laser Ablation.

7. The apparatus according to claim 1, wherein the orifice is formed by electroforming.

8. A method for ejecting ink from an apparatus using a bubble as a virtual valve, wherein the apparatus connected to an ink reservoir having the ink comprises a chamber, the chamber has a top surface and a bottom surface, an orifice for ejecting the ink is formed on the top surface, a first heater adjacent to a manifold and a second heater away from the manifold are formed on the bottom surface, the method comprising the steps of:

(a) activating the first heater and the second heater for generating a first bubble and a second bubble respectively, wherein the first bubble and the second bubble are enlarged towards the top surface of the chamber;

(b) expanding the first bubble in the chamber to function as the virtual valve for isolating the chamber from the manifold; and (c) expanding the second bubble for pressurizing the ink in the chamber with the first bubble, whereby the ink is ejected through the orifice and a droplet is formed.

9. The method according to claim 8, wherein after step (c), the first bubble collapses and breaks the isolation between the chamber and the manifold, and the ink refills the chamber.

10. A method for ejecting fluid from an apparatus using a bubble as a virtual valve, wherein the apparatus connected to a fluid reservoir having the fluid comprises a chamber, the chamber has a top surface and a bottom surface, an orifice for ejecting the fluid is formed on the top surface, a first bubble generator adjacent to a manifold and a second bubble generator away from the manifold are formed on the bottom surface, the method comprising the steps of:

(a) activating the first bubble generator and the second bubble generator for generating a first bubble and a second bubble respectively, wherein the first bubble and the second bubble are enlarged towards the top surface of the chamber;

(b) expanding the first bubble in the chamber to function as the virtual valve for isolating the chamber from the manifold; and (c) expanding the second bubble for pressurizing the fluid in the chamber with the first bubble, whereby the fluid is ejected through the orifice.

11. The method according to claim 10, wherein after step (c), the first bubble collapses and breaks the isolation between the chamber and the manifold, and the fluid refills the chamber.

* * * * *